US005911623A

United States Patent [19]

Trana et al.

[11] Patent Number: 5,911,623

[45] Date of Patent: Jun. 15, 1999

[54] EXHAUST EXTRACTOR DEVICE

[75] Inventors: Claes Trana; Tommie Persson, both of Göteborg, Sweden

[73] Assignee: AB Volve, Sweden

[21] Appl. No.: 08/913,623

[22] PCT Filed: Mar. 22, 1996

[86] PCT No.: PCT/SE96/00361

§ 371 Date: Dec. 4, 1997

§ 102(e) Date: Dec. 4, 1997

[87] PCT Pub. No.: WO96/29159

PCT Pub. Date: Sep. 26, 1996

[30] Foreign Application Priority Data

Mar. 22, 1995 [SE] Sweden ..... 9501006

[51] Int. Cl.[6] ..... B08B 15/00

[52] U.S. Cl. ..... 454/63; 138/89

[58] Field of Search ..... 454/49, 63, 64; 138/89

[56] References Cited

U.S. PATENT DOCUMENTS

| | | | |
|---|---|---|---|
| 2,733,668 | 2/1956 | Pfetzing | 454/63 X |
| 3,749,131 | 7/1973 | Burger | 138/89 |
| 4,750,525 | 6/1988 | Vaughan | 138/89 |
| 5,469,890 | 11/1995 | Carpentier | 138/89 |

FOREIGN PATENT DOCUMENTS

| | | | |
|---|---|---|---|
| 673719 | 11/1963 | Canada | 138/89 |
| 319 873 | 1/1970 | Sweden . | |
| 335 601 | 6/1971 | Sweden . | |
| 343 205 | 3/1972 | Sweden . | |
| 417 162 | 3/1981 | Sweden . | |
| 707570 | 4/1954 | United Kingdom | 138/89 |

*Primary Examiner*—Harold Joyce

*Attorney, Agent, or Firm*—Lerner, David, Littenberg, Krumholz & Mentlik, LLP

[57] ABSTRACT

Exhaust extractor device for evacuating vehicle exhaust gases from a working area and comprising a suction device for generating a vacuum in at least one suction hose (5) connected to a suction side of the suction device. The suction hose is provided at its end with a connector piece (9) for temporary attachment to the exhaust pipe of a motor vehicle. The connector piece is displaceable between an attachment position in which the exhaust pipe extends through a connector opening (19) into an open passage (20) through the connector piece, and a standby position in which the connector piece is removed from the exhaust pipe and is closed by means of a closure member (25). The closure member presents an internal sealing surface (26) located at a distance from the connector opening, and is in the form of a body having a peripherally extending sealing surface (27). In the standby position of the connector piece with the sealing member (25) introduced into the passage (2) of the connector piece, the sealing surface of the body cooperates with the sealing surface of the connector piece to thereby close the passage.

5 Claims, 5 Drawing Sheets

EXHAUST EXTRACTOR DEVICE

This application is a national stage of PCT/SE96/00361 filed Mar. 22, 1996.

TECHNICAL FIELD

The present invention relates to an exhaust extractor device for evacuating vehicle exhaust gases from a working area.

1. Technical Problem

Vehicle manufacturers, garages, testing stations, etc, in certain cases make use of installations for exhaust gas extraction for evacuation of exhaust gases from motor vehicles with running engines. Such insulations have suction hoses which are intended to be temporarily attached to the vehicles' exhaust pipe. In a typical installation there is generally a central suction fan which is in continuous operation irrespective of whether the hose is connected to the vehicle or whether it is in its standby position. Normally, there are several work-stations with hoses which are connected in parallel to a common suction fan. If the hose is kept open in a standby state, air will be continuously withdrawn, something which creates a disturbing suction noise and, when there are several work-stations with parallel hoses connected to a common suction fan, the suction power will thereby be negatively affected at those stations where a hose is connected. In addition, open suction hoses are energy-consuming, given the fact that heated room air is unnecessarily withdrawn from a place of work.

2. Background of the Invention

Attempts have been made to eliminate the above-mentioned problems by providing suction hoses in the standby position with a hinged closure flap which is intended to sealingly close against the connection opening to the connector piece which is located at the end of the hose, see for example SE-B 7709129-6. This type of closure arrangement places high demands on the precision and cleanliness of the sealing surfaces. However, the environment in question is relative demanding, the connector piece is dragged across dirty floors and runs the risk of being run over, which may lead to deformation thereof. In practise, this known closure arrangement does not function as intended; instead the flap will not form a complete seal because of deformation and dirt on the sealing surfaces, with disturbing suction sounds as a consequence.

The object of the present invention is to eliminate the above-mentioned drawbacks and thereby eliminate disturbing suction sounds in the standby position of the connector piece for exhaust gas extraction.

Solution

The above object is achieved by a device according to the present invention, the features of which are given in claim

BRIEF DESCRIPTION OF THE DRAWINGS

The invention will be described in the following in greater detail by means of one embodiment and with reference to the attached drawings, in which.

PREFERRED EMBODIMENT

Figure 1:
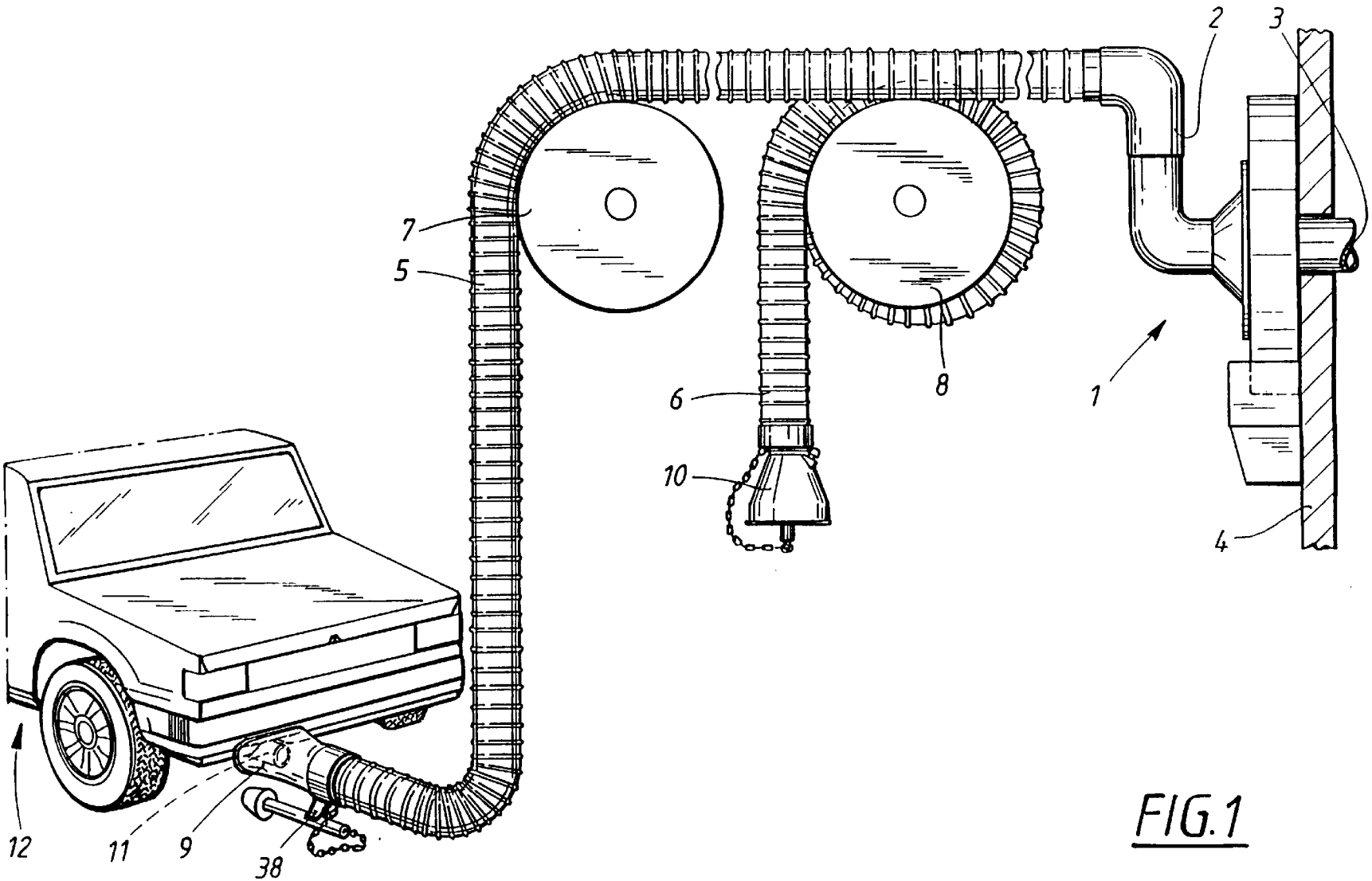
FIG. 1 shows an installation for exhaust gas extraction provided with the device according to the invention.

The device according to the invention forms a part of an installation for the evacuation of exhaust gases from motor vehicles and, as is apparent from FIG. 1, the installation consists of a suction device 1 which is schematically shown in the form of a suction fan 1 with a suction or inlet side 2 and a pressure or outlet side 3. This extends through a wall 4 or a roof of a building in which a number of work-stations for motor vehicles is arranged. The evacuation installation has a conduit system of suction hoses 5, 6 which, in the shown embodiment, each lead to a respective work-station and are connected to the inlet side 2 of the suction device 1. At least one section of each suction hose 5, 6 to each work-station is in the form of a flexible, reinforced hose which can be wound up on a hose winder 7, 8 at each station to thus be adjustable to desired length.

At the end of each suction hose there is arranged a connector piece 9, 10 which is intended for temporary attachment of the exhaust gas extractor to the exhaust pipe 11 of a vehicle 12. The connector pieces 9, 10 are adjustable between an operating attachment position in which the connector piece 9 is attached to the exhaust pipe, as is the case with the left-hand work-station, and a disconnected standby position which is the case for the right-hand work-station where the suction hose 6 has also been wound up so that the connector piece 10 hangs at such a height that it can be grasped and pulled down together with the associated hose to place it in the operating attachment position.

Figure 2:
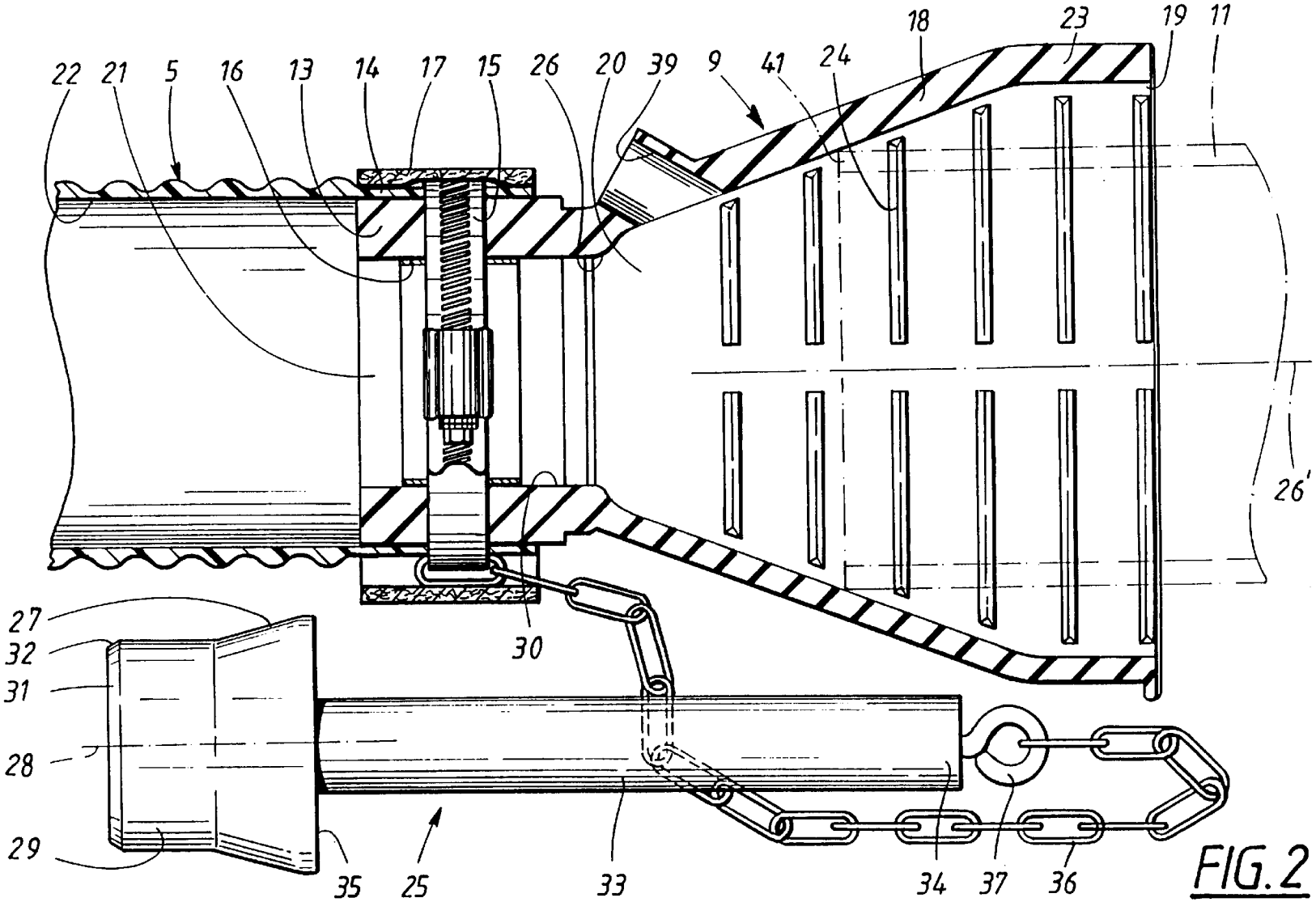
FIG. 2 shows a cross-sectional view on a larger scale through a connector piece in an attached position provided with the device according to the invention.

As is apparent from FIG. 2, the connector piece comprises a substantially cylindrically shaped region 13 onto which the end 14 of the hose 5 is introduced and retained by means of a hose clip 15. In order to create a shape-stable backing, a metal support ring 16 is arranged within the cylindrical region 13. The connector piece 9 is advantageously made from a somewhat elastic material, such as rubber, to facilitate the attachment to different shapes and dimensions of the outlet end of the vehicle's exhaust pipe 11. A soft protection ring 17 is positioned around the outside of the hose clip in order to protect the vehicle from damage. The connector piece has an attachment region 18 which, at least in the view shown in FIG. 2, expands in the shape of a funnel or cone towards an outer connector opening 19. In this manner, a passage 20 is formed through the connector piece from the outer opening 19 to an inner opening 21 which communicates with the suction channel 22 of the hose 5. In the shown example, in the region of the outer connector opening 19, the conical walls merge into an end section 23 with parallel walls. The attachment region 18 further displays a number of transverse splines 24 which provide increased grip on the end of the exhaust pipe 11.

In accordance with the invention, the connector piece 9 is provided with a closure member 25 which, in the standby position, is adapted to seal the connector piece so that the connected hose is maintained closed at its end 14. The closure member 25 is adapted in accordance with the invention to seal the connector piece and the suction hose 5 about a peripheral sealing surface 26 which faces to a greater extent radially inwardly towards the longitudinal axis of symmetry 26' of the connector piece than in the longitudinal direction of the connector piece. The sealing surface 26 is located in a protected position within the connector piece 9 at a distance from its connector opening 19. For this purpose, the closure member 25 is shaped as a three dimensional rotationally symmetric body with at least one peripheral sealing surface 27 which faces radially outwards from the longitudinal axis of symmetry 26' to a greater extent than in the longitudinal direction. In the illustrated embodiment, the sealing surface 27 of the closure member 25 has a circular cross-sectional shape and is in the form of a truncated cone with a relatively small conical angle, in the shown embodiment less than 30° to the longitudinal axis 28 of the closure member. The sealing surface 26 has a corresponding circular cross-sectional shape and can in principle also be conical, though it has been given the shape of a rounded edge which forms the transition between the cylindrical region 13 and the conical region 18.

The closure member 25 further presents a cylindrical region 29 which is thus adapted to the shape of the wall 30 of the cylindrical region 13 in the connector piece 9, though has a smaller cross-sectional extension to thereby not serve primarily as a sealing surface but instead as a guide surface for guidance during insertion and correct positioning of the sealing member 25 in the sealing position. A chamfered edge 32 is provided on the forward end 31 of the sealing member 25 in order to further facilitate the guidance during insertion. In the shown embodiment, the forward end 31 is flat, though it may have any arbitrary form.

Figure 3:
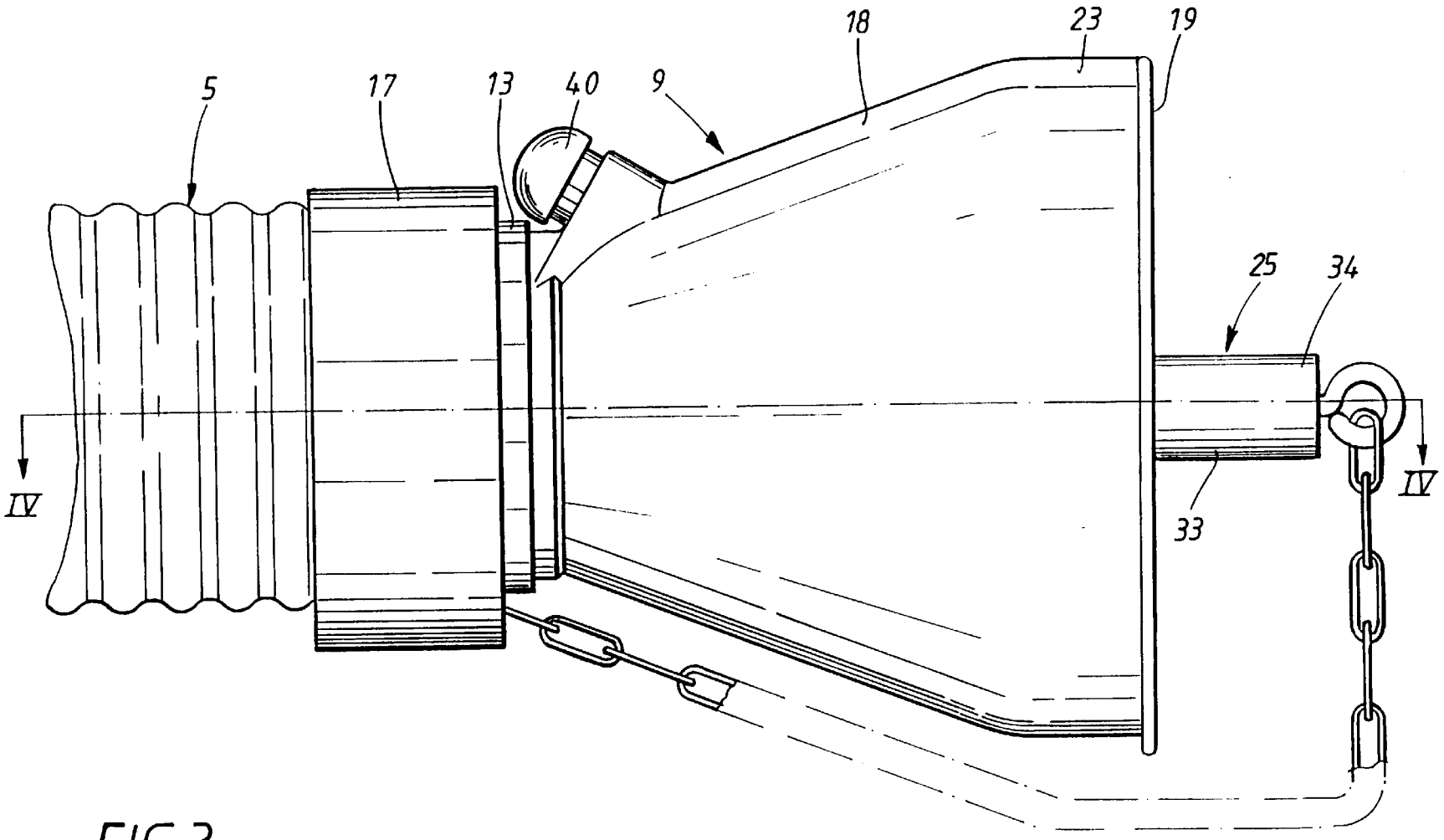
FIG. 3 shows a view corresponding to FIG. 2, though with the connector piece in a standby position, whilst
Figure 4:
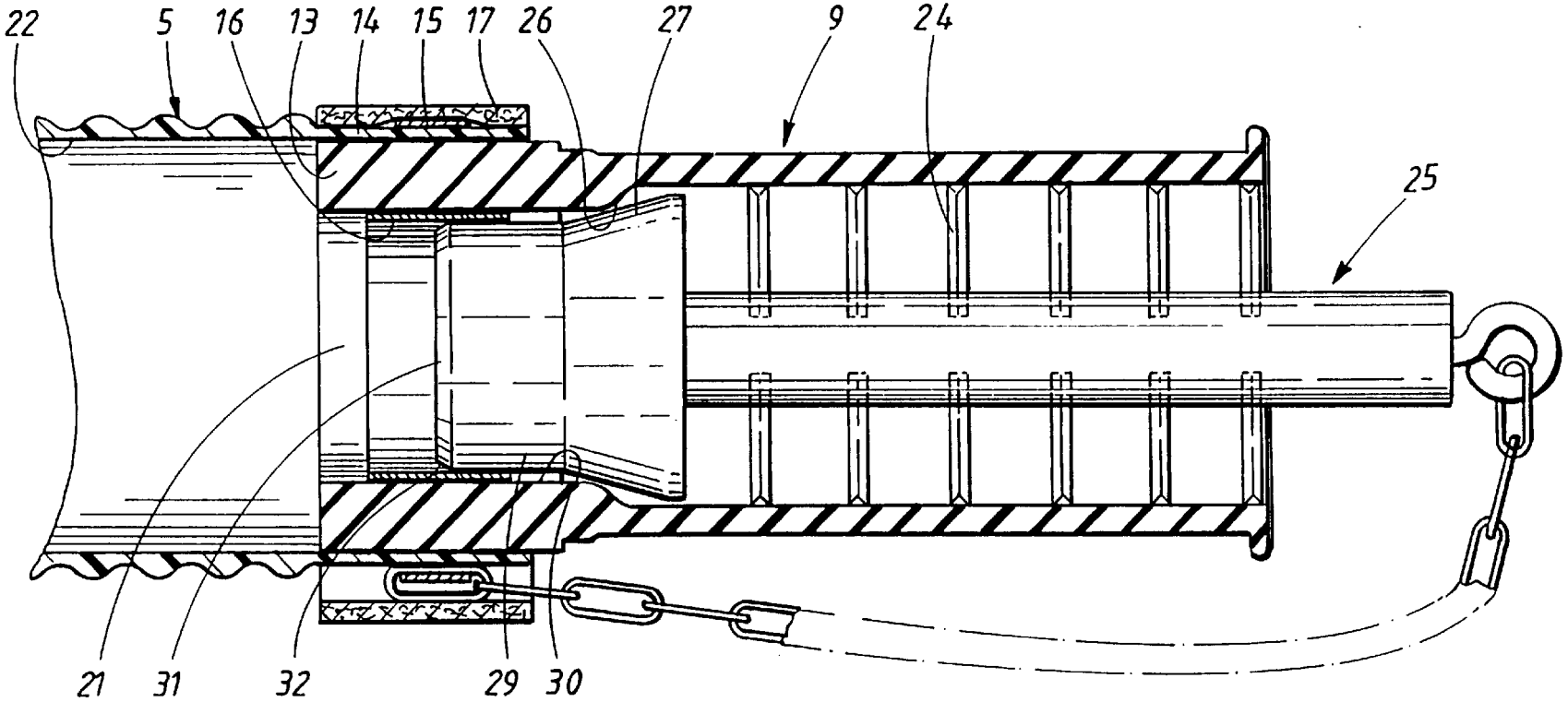
FIG. 4 shows a cross-sectional view through the connector piece along line IV—IV in FIG. 3, whilst

The closure member 25 further presents a grip part 33 which, in the shown embodiment, is in the form of a rod which extends symmetrically about the axis 28 in such a direction that, in the sealing position, it is positioned exterior of the sealing surface 27 with its outer end 34 extending somewhat beyond the connector opening 19 of the connector piece. The grip part 33 has a considerably smaller diameter than the diameter of the sealing surface, whereby the connector piece presents a reverse facing transition surface 35 which, in the shown embodiment, is flat and extends in a radial plane, though which can have any arbitrary shape. In the shown embodiment, the grip part has a connecting element 26 in the form of a chain which, by means of an attachment 37, is connected to the outer end 34 of the grip part and, at its opposite end, is connected to the hose clip 15. The connecting element 36 has such a length that the sealing member can comfortably be manipulated and moved between the attachment position shown in FIG. 2 and the closure position which is shown in FIGS. 3 and 4. In the attachment position, the closure member may hang freely outside the connector piece 9, though alternatively it may be maintained in some sort of holder on the outside of the connector piece as suggested in FIG. 1. The holder 38 can for example be in the form of a spring clip which extends around the grip part 31.

In the shown embodiment, the connector piece 9 has an additional connection possibility in the form of a side opening 39 which, in FIG. 2, is shown open and ready for connection of, for example, a measuring probe for measuring certain components in the exhaust gases. The opening is arranged in the conical region 18 of the connector piece and can be closed by a closure plug 40 when measurement is not required, as shown in FIG. 3.

Figure 5:
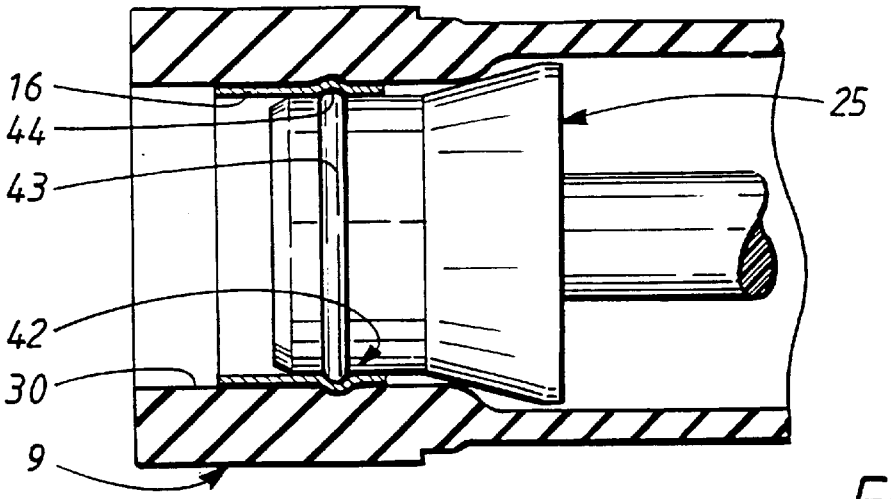
FIGS. 5–7 show three different arrangements for retaining a closure member in the standby position.
Figure 6:
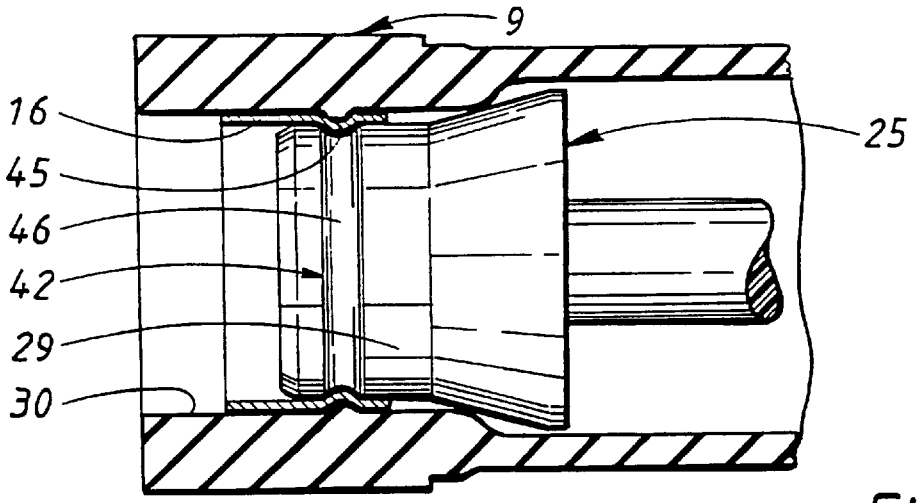
Figure 7:
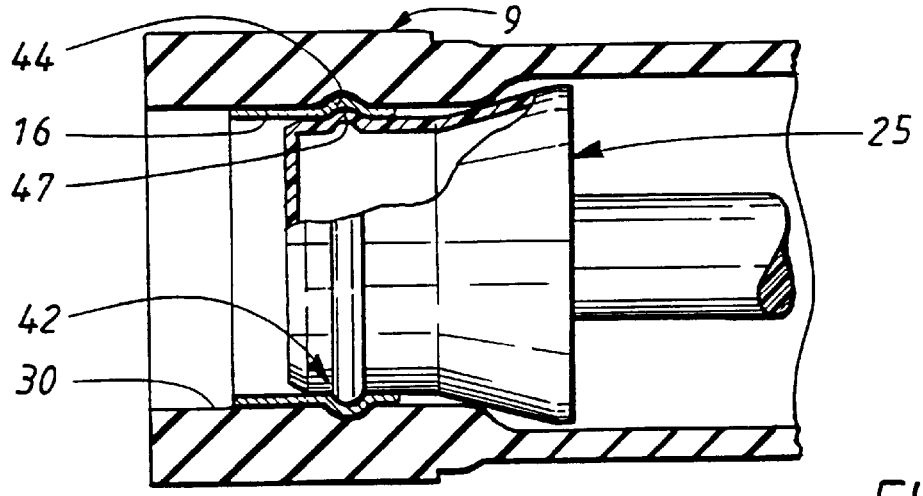

In order to further ensure the retention of the closure member 25 in the standby position, the connector piece 9 can be provided with a particular retaining arrangement 42 which is shown in three variants in FIGS. 5–7. The retaining arrangement 42 is, in the shown examples, adapted for shape-engagement in combination with certain friction between the connector piece 9 and the retaining arrangement 42.

The embodiment according to FIG. 5 shows the retaining arrangement 42 in the form of an elastic O-ring 43 positioned in a ring-shaped groove in the cylindrical guide surface 29 of the closure member 25. An engagement position is achieved against a ring-shaped groove 44 in the cylindrical region 13 of the connector piece 9.

The embodiment according to FIG. 6 shows the retaining arrangement 42 in the form of a ring-shaped bead 45 which retains the closure member 25 by engagement in a ring-shaped groove 46 in its cylindrical region 29. The engagement position can be adopted and left due to certain elasticity in the surrounding material.

In the embodiment according to FIG. 7, the O-ring 43 according to FIG. 5 has been replaced by a ring-shaped bead 47 in the cylindrical region 29 of the closure member 25. Also in this case a certain elasticity of the surfaces in question is required, for example as shown by using a non-solid closure member 25.

In the attachment position, the connector piece 9 is thus slipped over the outlet end of the exhaust pipe 11 so that the connector piece is fixedly maintained on the exhaust pipe by friction between the inner wall of the connector piece and the outside of the exhaust pipe or at least its opening edge 41. The closure member 25 is hereby outside the connector piece so that the passage 20 through the connector piece 9 is completely open, whereby the suction fan 1 which, at least during working hours, is continuously in operation, withdraws exhaust gases from the motor vehicle 12 whose engine is running by means of a suitably chosen vacuum in the suction hose 5.

When there is no longer a need for exhaust gas extraction, i.e. when the engine is stopped or when the vehicle is to be removed from the work-station, the connector piece 9 is released by a manual tug in a backwards direction, whereafter the closure member 25 is grasped with the hand around the grip part 33 and the closure member is inserted through the connector opening 19 with the end 31 first. The cylindrical region with the cylindrically shaped guide surface 29 is guided within the cylindrical region 13 of the connector piece until the conical sealing surface 27 comes into sealing contact with the sealing surface 26 of the connector piece. The guide surface 29 ensures that the sealing member 25 is maintained in a correct direction, i.e. with its longitudinal axis 28 along the longitudinal axis of the connector piece. A highly effective sealing is ensured by making the sealing surface 26 of the connector piece elastic to a certain degree and sealing with a good fit against the sealing surface 27 of the closure member 25, which sealing surface 27 can be a relatively hard and shape-permanent surface. For example, the connector piece can be made from delrin. The suction fan is still maintained in continuous operation since connector pieces can be attached to vehicles in operation at other work-stations. The vacuum which is created in the suction hose in question further contributes to the retention of the closure member 25 in its sealing position. Thus, in the standby position for the connector piece 10, and as shown in the right-hand work-station in FIG. 1, the connector piece 10 is completely sealed, whereby the connector piece is totally silent and the suction capacity of the continuously operated suction fan can be fully utilized at the other work-stations where connector pieces are in an attachment position, as shown in the left-hand work-station. One and the same evacuation insulation can comprise a plurality of work-stations which can be switched individually between operating attachment positions and standby positions. The hose winders 7 and 8 can advantageously be spring-biased so that the connector pieces 10 in the standby position are automatically raised together with the associated suction hose to a suitably withdrawn position.

The connector piece is manipulated from the standby position to the operating attachment position by a person manually gripping the suction hose or the connector piece 10 and pulling it down so that the hose winder unwinds the necessary length of hose, whereafter the closure member 25 is pulled out by manually gripping the grip part 31 and the connector piece is slipped over the exhaust pipe in question.

The invention is not restricted to the embodiments described above and shown in the drawings but may be varied within the scope of the appended claims.

For example, but the connector piece and the closure member 25 may have different shapes in terms of both the sealing surfaces and the shape of the grip part 33.

We claim:

1. Exhaust extractor apparatus for evacuating vehicle exhaust gases from a working area and comprising a suction device having a suction side for generating a vacuum, at least one suction hose having an end connected to said suction side of said suction device, said end of said at least one suction hose being provided with a connector piece adapted for temporary attachment to the exhaust pipe of a motor vehicle, said connector piece including an open end and a passageway and being displaceable between an attachment position in which said exhaust pipe extends through said open end of said connector piece into raid passageway through said connector piece, and a standby position in which said connector piece is removed from said exhaust pipe, and a closure member for closing said connector piece when in said standby position, said connector piece including an internal sealing surface located at a distance from said open end of said connector piece and a substantially cylindrical region and said closure member is in the form of a body having a peripherally extending sealing surface which is adapted to cooperate with said sealing surface of said connector piece to thereby close said passageway and said closure member having a substantially cylindrical guide surface which is adapted to cooperate with said substantially cylindrical region of said connector piece whereby said closure member may be guided to a coaxial position during insertion into said connector piece.

2. The apparatus according to claim 1, wherein said sealing surface of said closure member is conical.

3. The apparatus according to claim 1, wherein said closure member includes a grip portion which is accessible through said open end of said connector piece when said connector piece is in said sealing position.

4. The apparatus according to claim 1, wherein said connector piece includes a funnel-shaped attachment region, and said sealing surface of said connector piece is formed by a convex transition from said substantially cylindrical region said funnel-shaped attachment region.

5. The apparatus according to claim 1 including means for retaining said closure member in said standby position by essentially shape engagement.

* * * * *

UNITED STATES PATENT AND TRADEMARK OFFICE

CERTIFICATE OF CORRECTION

PATENT NO. : 5,911,623

DATED : June 15, 1999

INVENTOR(S) : Trana, et. al.

It is certified that error appears in the above-identified patent and that said Letters Patent is hereby corrected as shown below:

On the Title Page, item [73], "Volve" should read --Volvo--.

Column 1, line 40, "relative" should read --relatively--.

Column 1, line 41, "is" should read --being--.

Column 1, line 41, "runs" should read --running--.

Column 1, line 53, after "claim" insert --1--.

Column 2, line 13, "is" should read --are--.

Column 3, line 17, before "has" insert --it--.

Column 3, line 35, "though which" should read --although it--.

Column 3, line 47, after "can" insert --,--.

Column 3, line 48, after "example" insert --,--.

Column 5, line 11, delete "but".

Column 5, line 25, "raid" should read --said--.

Column 6, line 4, delete "is"

Column 6, line 22, after "region" insert --to--.

Signed and Sealed this

Thirtieth Day of November, 1999

*Attest:*

*Attesting Officer*

Q. TODD DICKINSON

*Acting Commissioner of Patents and Trademarks*